US010576730B2

(12) United States Patent
Igarashi et al.

(10) Patent No.: US 10,576,730 B2
(45) Date of Patent: Mar. 3, 2020

(54) METHOD FOR PREPARING LITHOGRAPHIC PRINTING PLATES

(71) Applicant: Eastman Kodak Company, Rochester, NY (US)

(72) Inventors: Akira Igarashi, Kumagaya (JP); Satoshi Ishii, Oura-gun (JP)

(73) Assignee: EASTMAN KODAK COMPANY, Rochester, NY (US)

( * ) Notice: Subject to any disclaimer, the term of this patent is extended or adjusted under 35 U.S.C. 154(b) by 253 days.

(21) Appl. No.: 15/653,809

(22) Filed: Jul. 19, 2017

(65) Prior Publication Data

US 2019/0022993 A1 Jan. 24, 2019

(51) Int. Cl.
*B41C 1/10* (2006.01)

(52) U.S. Cl.
CPC ..... *B41C 1/10* (2013.01); *B41C 2210/04* (2013.01)

(58) Field of Classification Search
None
See application file for complete search history.

(56) References Cited

U.S. PATENT DOCUMENTS

| | | | | |
|---|---|---|---|---|
| 6,341,932 | B1 | 1/2002 | Otsuji | |
| 6,840,176 | B1 | 1/2005 | Armoni | |
| 7,861,940 | B2 | 1/2011 | Cummings et al. | |
| 8,739,702 | B2 | 6/2014 | Korolik et al. | |
| 2006/0219106 | A1* | 10/2006 | Sato | B41L 13/06 101/128.4 |

* cited by examiner

*Primary Examiner* — Joshua D Zimmerman
(74) *Attorney, Agent, or Firm* — J. Lanny Tucker

(57) ABSTRACT

The imaging sensitivity of negative-working lithographic printing plate precursors is improved by removing ozone from the ambient air surrounding the precursors that can be stored near an imaging means such as a platesetter prior to use. Ozone can be removed using a suitable filter containing activated charcoal or other ozone decomposing means, through which ambient air is filtered before and during the imaging process.

14 Claims, 4 Drawing Sheets

METHOD FOR PREPARING LITHOGRAPHIC PRINTING PLATES

FIELD OF THE INVENTION

This invention relates to a method for preparing lithographic printing plates from negative-working lithographic printing plate precursors in an environment with reduced levels of ambient ozone that can adversely affect the imaging sensitivity of the precursors. This method is particularly useful during imaging of precursors that are stored near and automatically loaded onto imaging apparatus. Such imaged precursors can be readily developed on-press during lithographic printing operations.

BACKGROUND OF THE INVENTION

Imaging systems, such as computer-to-plate (CTP) imaging systems are known in the art and are used to record an image on a lithographic printing plate precursor. Such precursors comprise a planar substrate typically composed of aluminum that has a hydrophilic surface on which one or more radiation-sensitive imageable layers are disposed. In lithographic printing, lithographic ink receptive regions, known as image areas, are generated on the hydrophilic surface of the planar substrate. When the printing plate surface is moistened with water and a lithographic printing ink is applied, hydrophilic regions retain the water and repel the lithographic printing ink, and the lithographic ink receptive image regions accept the lithographic printing ink and repel the water. The lithographic printing ink is transferred to the surface of a material upon which the image is to be reproduced, perhaps with the use of a blanket roller.

Lithographic printing plate precursors are considered either "positive-working" or "negative-working." Positive-working lithographic printing plates precursors are designed with one or more radiation-sensitive layers such that upon imagewise exposure to suitable radiation, the exposed regions of the layers become more alkaline solution soluble and can be removed during processing to leave the non-exposed regions that accept lithographic ink for printing.

In contrast, negative-working lithographic printing plate precursors are designed with a radiation-sensitive layer such that upon imagewise exposure to suitable radiation, the exposed regions of the layer are hardened and become resistant to removal during processing, while the non-exposed regions are removable during processing that can be carried out on-press during lithographic printing in the presence of a fountain solution, lithographic printing ink, or both.

In the current state of the art in the lithographic printing industry, lithographic printing plate precursors are usually imagewise exposed to imaging radiation such as infrared radiation using lasers in an imaging device commonly known as a platesetter (for CTP imaging) before additional processing (development) to remove unwanted materials from the imaged precursors. Manufacturers typically provide precursors in "stacks" of equivalently-sized elements, perhaps separated from each other by interleaf paper. A stack of precursors can be delivered on a pallet or other structure that provides support and simplifies conveyance. Alternatively, a stack of precursors can be held within a carton, cassette, or other protective enclosure that provides desired protection and orientation for use.

Many imaging systems provide integrated storage facilities for a quantity (stack) of lithographic printing plate precursors to be used and provide automated mechanisms or apparatus for selecting and loading each precursor for imaging. For example, a platesetter can be used with an autoloader (or loading apparatus or plate feeding apparatus) that automatically picks up an individual precursor from a stack and loads it onto an imaging drum where each precursor is appropriately imagewise exposed with suitable radiation. Such a combination of features in an imaging apparatus provides for considerable automation and high throughput for certain high production printing jobs such as the printing of newsprint. The stacks of multiple lithographic printing plate precursors can be arranged in a supply area near the platesetter, ready for loading using the autoloader.

U.S. Pat. No. 6,840,176 (Armoni) describes a CTP system comprising imaging units and a stack of lithographic printing plate precursors aligned for automatic loading into the imaging units (platesetters). An apparatus for loading lithographic printing plates is also described in U.S. Pat. No. 8,739,702 (Korolik et al.) and a plate handling system for this purpose is described in U.S. Pat. No. 7,861,940 (Cummings et al.).

In such automatic printing operations, the lithographic printing plate precursors are often stored for an extended period near the platesetter without any covering to protect the radiation-sensitive imageable layer in each precursor from ambient conditions.

It has been found that certain lithographic printing plate precursors such as negative-working lithographic printing plate precursors, are susceptible to loss of imaging sensitivity when exposed to ambient ozone without a protective covering near or inside a platesetter. Ambient ozone content is typically around 50 ppb and can be higher near electric equipment because of ozone generated by such equipment. Having discovered this problem from the action of ozone, there is a need to solve it for the lithographic printing industry so that imaging sensitivity is not lost and high-speed lithographic printing of newsprint can be achieved efficiently.

SUMMARY OF THE INVENTION

The present invention provides a method for preparing one or more lithographic printing plates from one or more negative-working lithographic printing plate precursors, comprising:

providing an imaging apparatus comprising: imaging means; and an enclosure that completely surrounds the imaging means, which enclosure comprises an air intake unit for providing controlled air flow into the enclosure;

using a means for removing ozone either from the controlled air flow into the enclosure or from ambient air within the enclosure;

supplying one or more negative-working lithographic printing plate precursors to the imaging means, each negative-working lithographic printing plate precursor comprising a substrate having thereon a negative-working imageable layer;

imagewise exposing the one or more negative-working lithographic printing plate precursors to provide one or more imaged precursors comprising exposed regions and non-exposed regions in the negative-working imageable layer; and processing the one or more imaged precursors to remove the non-exposed regions in the negative-working imageable layer, to form one or more lithographic printing plates.

In some embodiments of this invention, the imaging apparatus further comprises a stack of multiple negative-working lithographic printing plate precursors; and an automatic loading device, and the step of supplying one or more negative-working lithographic printing plate precursors to the imaging means is performed by operating the automatic loading device to load one or more negative-working lithographic printing plate precursors from the stack onto the imaging means.

Once the stated problem of imaging sensitivity loss in stored precursors near or inside an imaging apparatus was discovered, it was found that the problem can be solved by a special ozone removing means to minimize the ozone level in air to which the precursors are exposed. For platesetters (imaging means) that are used in a housing that encloses one or more stacks of precursors together with the imaging device and the automatic loading device, ozone removing means can be provided, for example in the form of an ozone-removing filter to remove ozone. Such an ozone removing filter can contain activated charcoal, an ozone decomposing catalyst, or both. The ozone removing means can be one or more air purification devices placed inside an imaging apparatus housing. Such air purification devices can be used to treat ambient air inside or outside the imaging apparatus housing.

DETAILED DESCRIPTION OF THE INVENTION

Figure 1:
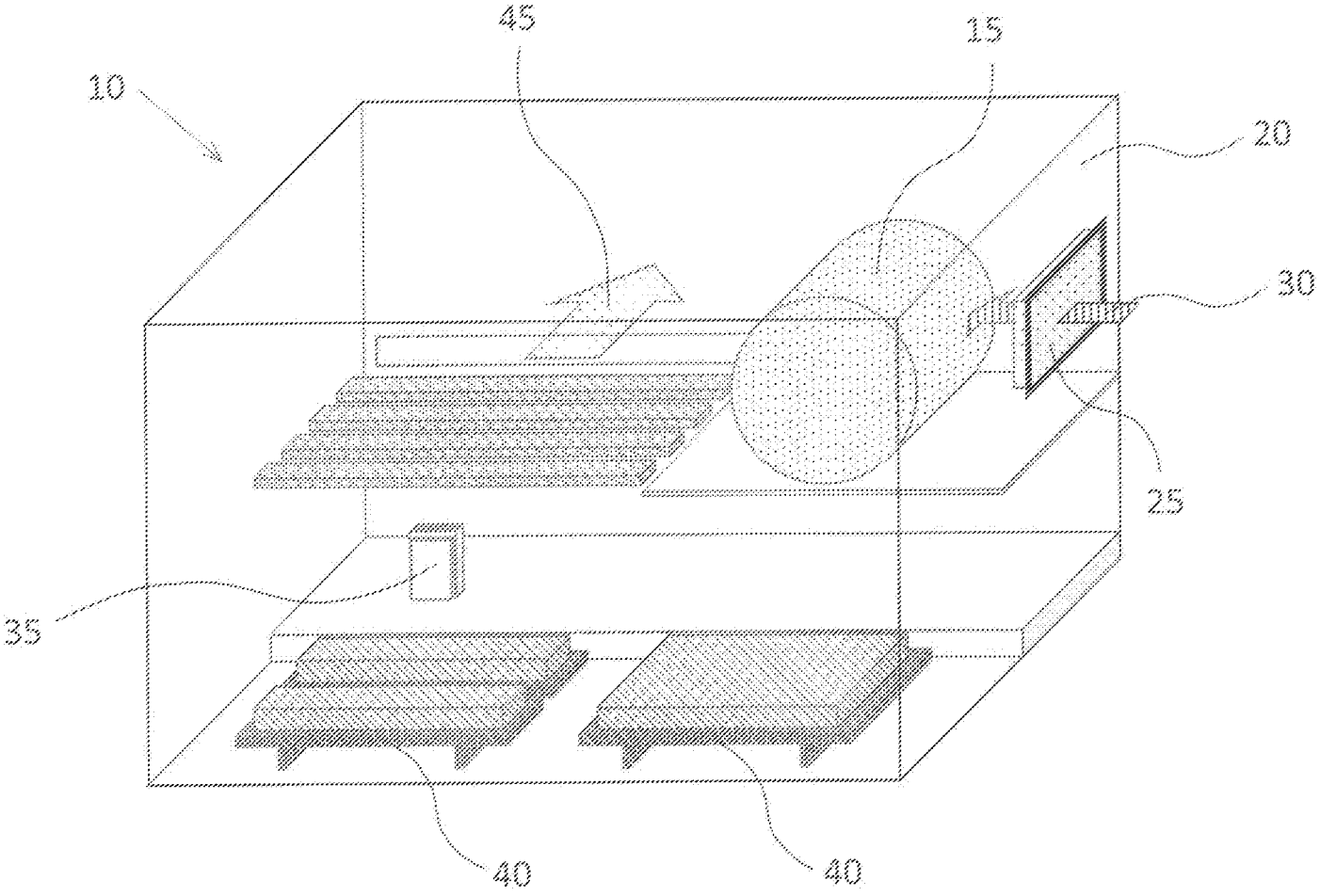
FIG. 1 is a schematic illustration of an embodiment of the present invention as illustrated in Invention Example 1 below.

The following discussion is directed to various embodiments of the present invention and while some embodiments can be desirable for specific uses, the disclosed embodiments should not be interpreted or otherwise considered to limit the scope of the present invention, as claimed below. In addition, one skilled in the art will understand that the following disclosure has broader application than is explicitly described in the discussion of any embodiment.

Definitions

As used herein to define various components of the negative-working imageable layer and formulation and other materials used in the practice of this invention, unless otherwise indicated, the singular forms "a," "an," and "the" are intended to include one or more of the components (that is, including plurality referents).

Each term that is not explicitly defined in the present application is to be understood to have a meaning that is commonly accepted by those skilled in the art. If the construction of a term would render it meaningless or essentially meaningless in its context, the term should be interpreted to have a standard dictionary meaning.

The use of numerical values in the various ranges specified herein, unless otherwise expressly indicated otherwise, are approximations as though the minimum and maximum values within the stated ranges were both preceded by the word "about." In this manner, slight variations above and below the stated ranges may be useful to achieve substantially the same results as the values within the ranges. In addition, the disclosure of these ranges is intended as a continuous range including every value between the minimum and maximum values as well as the end points of the ranges.

Unless the context indicates otherwise, when used herein, the terms "negative-working lithographic printing plate precursor," "precursor," and "lithographic printing plate precursor" are meant to be equivalent references to embodiments used in the practice of the present invention.

The term "support" is used herein to refer to an aluminum-containing material (web, strip, sheet, foil, or other form) that can then be treated or coated to prepare a "substrate" that refers to a hydrophilic article having a hydrophilic planar surface upon which various layers are disposed.

As used herein, the term "infrared radiation absorber" refers to a compound or material that absorbs electromagnetic radiation in the infrared region and typically refers to compounds or materials that have an absorption maximum in the infrared region.

As used herein, the term "infrared region" refers to radiation having a wavelength of at least 750 nm and higher. In most instances, the term "infrared" is used to refer to the "near-infrared" region of the electromagnetic spectrum that is defined herein to be at least 750 nm and up to and including 1400 nm.

For clarification of definitions for any terms relating to polymers, reference should be made to "Glossary of Basic Terms in Polymer Science" as published by the International Union of Pure and Applied Chemistry ("IUPAC"), *Pure Appl. Chem.* 68, 2287-2311 (1996). However, any definitions explicitly set forth herein should be regarded as controlling.

As used herein, the term "polymer" is used to describe compounds with relatively large molecular weights formed by linking together many small reacted monomers. As the polymer chain grows, it folds back on itself in a random fashion to form coiled structures. With the choice of solvents, a polymer can become insoluble as the chain length grows and become polymeric particles dispersed in the solvent medium. These particle dispersions can be very stable and useful in radiation-sensitive imageable layers described for use in the present invention. In this invention, unless indicated otherwise, the term "polymer" refers to a non-crosslinked material. Thus, crosslinked polymeric particles differ from the non-crosslinked polymeric particles in that the latter can be dissolved in certain organic solvents of good solvating property whereas the crosslinked polymeric particles may swell but do not dissolve in the organic solvent because the polymer chains are connected by strong covalent bonds.

The term "copolymer" refers to polymers composed of two or more different repeating or recurring units that are arranged along the polymer backbone.

The term "backbone" refers to the chain of atoms in a polymer to which a plurality of pendant groups can be attached. An example of such a backbone is an "all carbon" backbone obtained from the polymerization of one or more ethylenically unsaturated polymerizable monomers.

Recurring units in polymeric binders described herein are generally derived from the corresponding ethylenically unsaturated polymerizable monomers used in a polymerization process, which ethylenically unsaturated polymerizable monomers can be obtained from various commercial sources or prepared using known chemical synthetic methods.

As used herein, the term "ethylenically unsaturated polymerizable monomer" refers to a compound comprising one or more ethylenically unsaturated (—C═C—) bonds that are polymerizable using free radical or acid-catalyzed polymerization reactions and conditions. It is not meant to refer to chemical compounds that have only unsaturated —C═C— bonds that are not polymerizable under these conditions.

Unless otherwise indicated, the term "weight %" refers to the amount of a component or material based on the total solids of a composition, formulation, or layer. Unless otherwise indicated, the percentages can be the same for either a dry layer or the total solids of the formulation or composition.

As used herein, the term "layer" or "coating" can consist of one disposed or applied layer or a combination of several sequentially disposed or applied layers. If a layer is considered infrared radiation-sensitive and negative-working, it is both sensitive to radiation (as described above for "radiation-absorber") and negative-working in the formation of lithographic printing plates.

Uses

The method of this invention is useful to prepare lithographic printing plates ready for lithographic printing by imagewise exposing and processing the exposed precursor off-press using a suitable developer or on-press using a lithographic printing ink, a fountain solution, or a combination of a lithographic printing ink and a fountain solution as described below.

Imaging Apparatus and Use

The method of the present invention can be further understood by reference to FIGS. 1-4 that illustrate particular embodiments that are demonstrated in Invention Example 1-4 below, but the present invention is not limited to use of the specific imaging apparatus shown in FIGS. 1-4.

In FIG. 1, imaging apparatus 10 is shown with imaging means 15 that is typically a platesetter such as those described in more detail below, but can be other machines that are designed for imaging negative-working lithographic printing plate precursors. Imaging means 15 is typically located within enclosure 20 (or housing) that can be a housing of a specific design for a particular imaging machine, or it can be a specially designed room. Within enclosure 20 is a means for bringing in untreated ambient air such as air intake unit 25 that can be designed to have one or more air entrances and is generally connected to a means (not shown) for providing and controlling the flow of untreated ambient air into enclosure 20. Ambient air flow through air intake unit 25 into enclosure 20 is shown with arrow 30.

Ozone removing means 35 that can comprise one or more ozone-removing filters designed with chemical components that will absorb ozone from the untreated ambient air, such as activated charcoal, an ozone decomposition chemical (catalyst), can be situated within enclosure 20 (housing) near imaging means 15 so that the untreated ambient air brought into contact with and circulating around imaging means 15 is very likely to pass through ozone removing means 35, thereby reducing the concentration of ozone of circulating within enclosure 20 for example, by at least 50 mol %, or even at least 80 mol %, based on the original amount of ozone in the untreated ambient air within enclosure 20 or controlled air introduced into enclosure 20. One skilled in the art can readily design ozone removing means 35 to accomplish this result based on the knowledge of the amount of ozone in the untreated ambient air (typically about 50 parts per billion) and the volume or rate of untreated ambient air being brought into enclosure 20.

Stacks of multiple negative-working lithographic printing plate precursors are shown as pallets 40 of such precursors, located within imaging apparatus 10 near imaging means 15 and ozone removing means 35. The stack of multiple precursors can have interleaf papers disposed between adjacent precursors, but one advantage of the present invention is that the negative-working lithographic printing plate precursors on pallets 40 can be stored without interleaf papers and imaging sensitivity is not seriously reduced by ozone in the ambient air circulating within enclosure 20. In the embodiment shown in FIG. 1, it is possible to reduce the adverse effect on the negative-working imaging layer chemistry in one or more of the multiple precursors that are exposed to circulating ambient air before they are loaded onto imaging means 15. Thus, ozone removing means 35 is in close proximity to both pallets 40 of lithographic printing plate precursors, an autoloading device (not shown), and imaging means 15. Each imaged precursor can be moved away from imaging means 15 in a direction represented by arrow 45 to a suitable off-press processing (development) apparatus or to a printing press for on-press development. Processing conditions, apparatus, and solutions are described below in detail.

Figure 2:
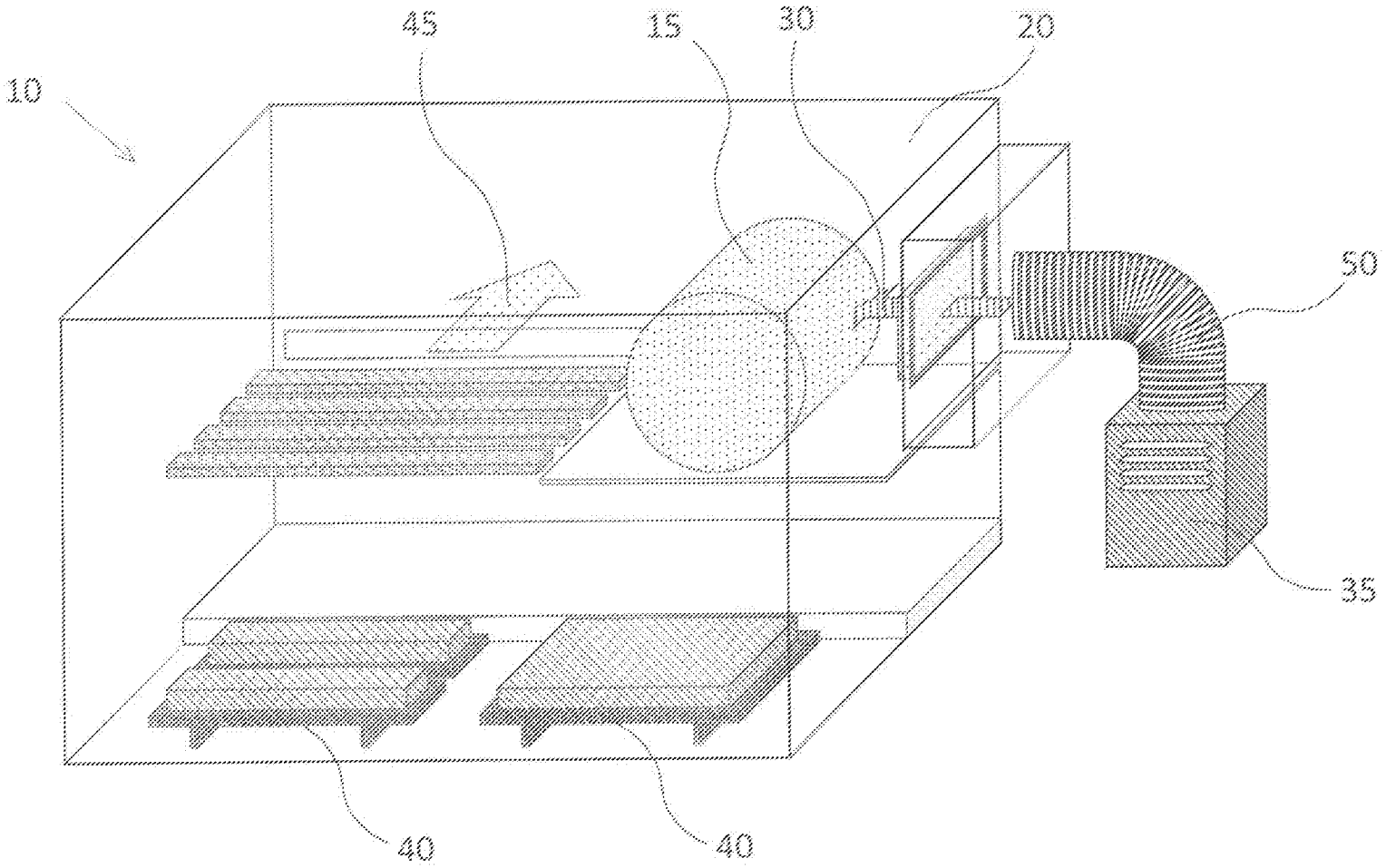
FIG. 2 is a schematic illustration of another embodiment of the present invention as illustrated in Invention Example 2 below.

FIG. 2 shows a modification of imaging apparatus 10 as illustrated in FIG. 1. The difference is that ozone removing means 35 is situated outside enclosure 20 and only treated ambient air is allowed to enter enclosure 20 through a suitable means to direct the treated ambient air, such as through flexible air tube 50 or a similar tube or conduit useful for controlling and directing ambient air flow 30 (now treated air).

Figure 3:
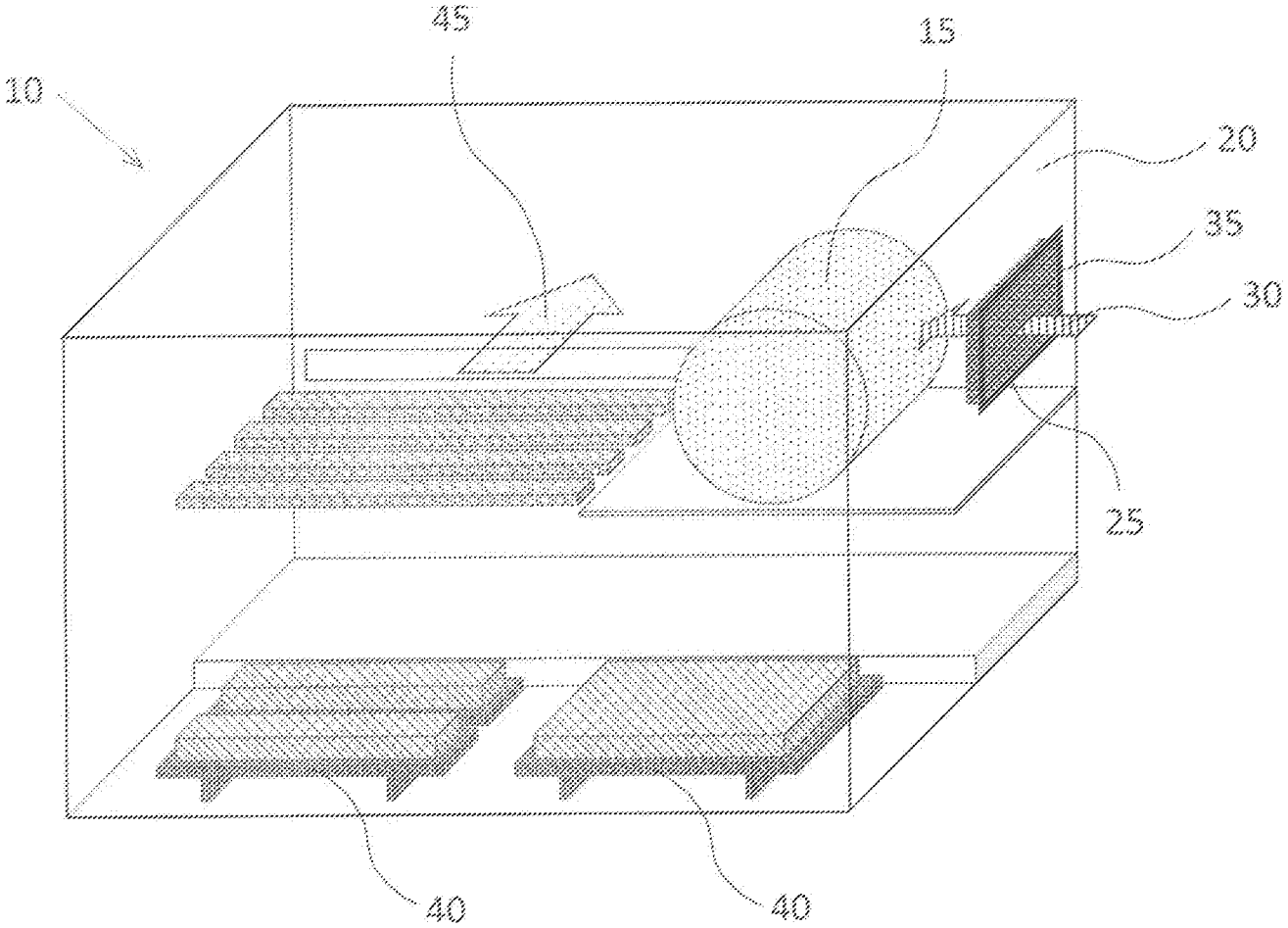
FIG. 3 is a schematic illustration of yet another embodiment of the present invention as illustrated in Invention Example 3 below.

FIG. 3 illustrates yet another arrangement of the features useful for carrying out the present invention. The features are the same as those illustrated in FIG. 1 except that ozone removing means 35 is situated directly in air intake unit 25 so that untreated ambient air must pass through air intake unit 25 before it is circulated within enclosure 20 as ambient air flow 30 (now treated air). In such embodiments, ozone removing means 35 can be incorporated within one or more fan units comprising one or more fans within each unit and one or more ozone removing filters placed in the path of ambient air flow 30 of the one or more fan units, the one or more fan units being located within the one or more openings (not shown) of air intake unit 25.

Figure 4:
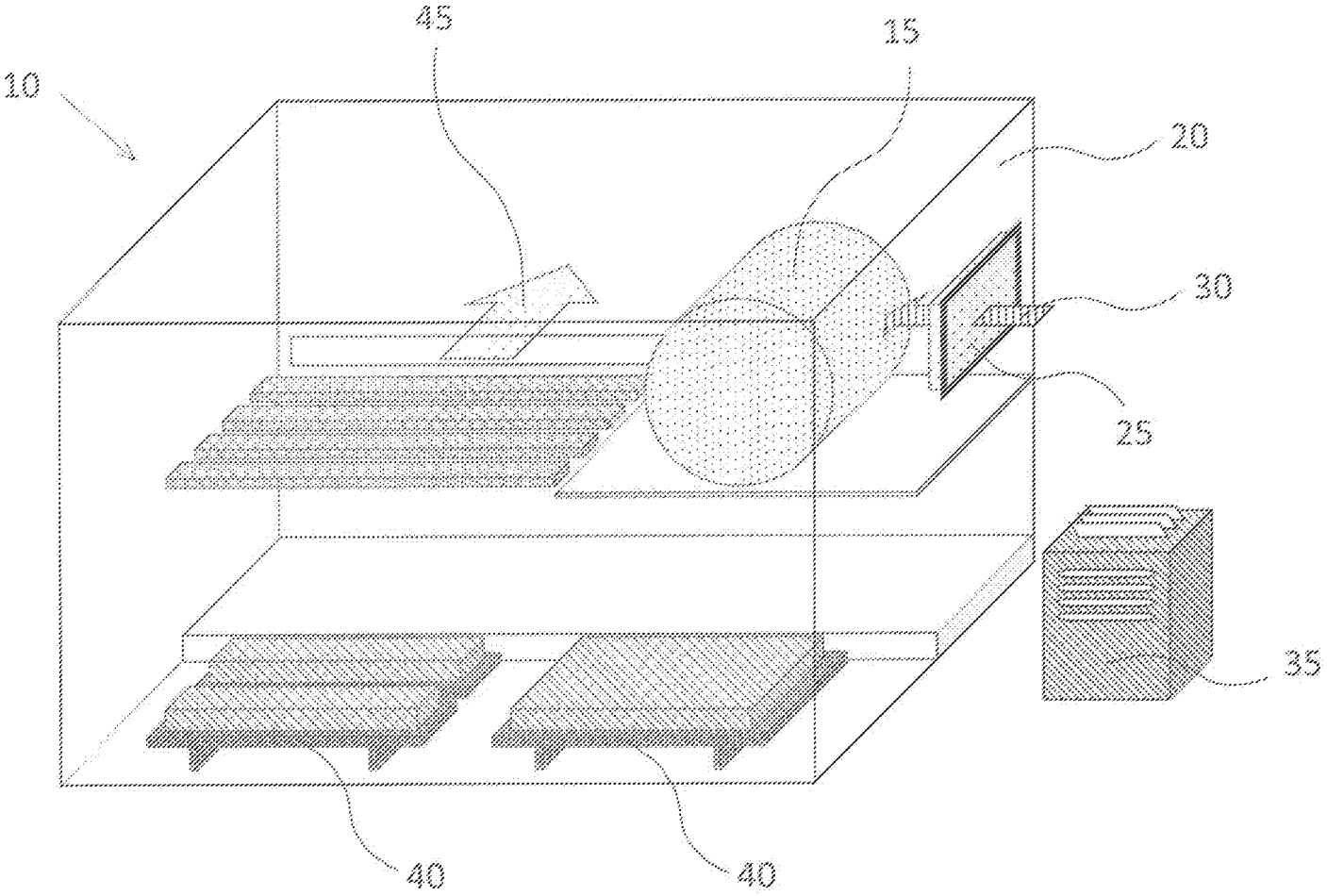
FIG. 4 is a schematic illustration of still another embodiment of the present invention as illustrated in Invention Example 4 below.

Lastly, imaging apparatus 10 illustrated in FIG. 4 is like that illustrated in FIG. 2 except that ambient air is treated using ozone removing means 35 that is located in a room containing imaging apparatus 10.

Negative-Working Lithographic Printing Precursors

Negative-working lithographic printing plate precursors useful in the present invention can be constructed using the following components and materials. Typically, each precursor has a substrate on which is disposed a negative-working imageable layer comprising suitable chemistry for radiation imaging and suitable processing to remove non-exposed regions of the imaging layer.

Substrate:

The substrate that is present in the precursors generally has a hydrophilic imaging-side planar surface, or at least a surface that is more hydrophilic than the applied negative-working imageable layer on the imaging side of the substrate. The substrate comprises a support that can be composed of any material that is conventionally used to prepare lithographic printing plate precursors.

One useful substrate is composed of an aluminum-containing support that can be treated using techniques known in the art, including roughening of some type by physical (mechanical) graining, electrochemical graining, or chemical graining, which is followed by anodizing. Anodizing is typically done using phosphoric or sulfuric acid and conventional procedures to form a desired hydrophilic aluminum oxide (or anodic oxide) layer or coating on the aluminum-containing support, which aluminum oxide (anodic oxide) layer can comprise a single layer or a composite of multiple layers having multiple pores with varying depths and shapes of pore openings. Such processes thus provide an anodic oxide layer underneath the negative-working imageable layer that can be provided as described below.

An anodized aluminum support can be treated further to seal the anodic oxide pores or to further hydrophilize its surface, or both, using known post-anodic treatment (PAT) processes, such as post-treatments in aqueous solutions of poly(vinyl phosphonic acid) (PVPA), vinyl phosphonic acid copolymers, poly[(meth)acrylic acid] or its alkali metal salts, or acrylic acid copolymers or their alkali metal salts, mixtures of phosphate and fluoride salts, or sodium silicate.

The thickness of a substrate can be varied but should be sufficient to sustain the wear from printing and thin enough to wrap around a printing form. Useful embodiments include a treated aluminum foil having a thickness of at least 100 μm and up to and including 700 μm. The backside (non-imaging side) of the substrate can be coated with antistatic agents, a slipping layer, or a matte layer to improve handling and "feel" of the precursor.

The substrate is generally formed as a continuous roll (or continuous web) of sheet material that is suitably coated with a negative-working imageable layer formulation and optionally a protective layer formulation, followed by slitting or cutting (or both) to size to provide individual lithographic printing plate precursors having a shape or form having four right-angled corners (thus, typically in a square or rectangular shape or form). Typically, the cut individual precursors have a planar or generally flat rectangular shape.

Negative-Working Imageable Layer:

The precursors can be formed by suitable application of a negative-working radiation-sensitive composition as described below to a suitable substrate (as described above) to form a negative-working imageable layer on that substrate. In general, the negative-working radiation-sensitive composition (and resulting radiation-sensitive imageable layer) comprises: (a) one or more free radically polymerizable components, (b) an initiator composition that provides free radicals upon exposure of the negative-working imageable layer to imaging radiation, and (c) one or more radiation absorbers, as essential components, and optionally, a polymeric binder different from all of the foregoing (a), (b), and (c) components, all of which essential and optional components are described in more detail below. Such negative-working imageable layer is generally the outermost layer in the precursor, but in some embodiments, there can be an outermost water-soluble hydrophilic protective layer (also known as a topcoat or oxygen barrier layer) disposed over the negative-working imageable layer.

The radiation-sensitive composition (and negative-working imageable layer prepared therefrom) comprises one or more free radically polymerizable components, each of which contains one or more free radically polymerizable groups (and two or more of such groups in some embodiments) that can be polymerized using free radical initiation. In some embodiments, the negative-working imageable layer comprises two or more free radically polymerizable components having the same or different numbers of free radically polymerizable groups in each molecule.

Useful free radically polymerizable components can contain one or more free radical polymerizable monomers or oligomers having one or more addition polymerizable ethylenically unsaturated groups (for example, two or more of such groups). Similarly, crosslinkable polymers having such free radically polymerizable groups can also be used. Oligomers or prepolymers, such as urethane acrylates and methacrylates, epoxide acrylates and methacrylates, polyester acrylates and methacrylates, polyether acrylates and methacrylates, and unsaturated polyester resins can be used. In some embodiments, the free radically polymerizable component comprises carboxyl groups.

It is possible for one or more free radically polymerizable components to have large enough molecular weight or to have sufficient polymerizable groups to provide a crosslinkable polymer matrix that functions as a "polymeric binder" for other components in the negative-working imageable layer. In such embodiments, a separate non-polymerizable or non-crosslinkable polymer binder (described below) is not necessary but still may be present.

Free radically polymerizable components include urea urethane (meth)acrylates or urethane (meth)acrylates having multiple (two or more) polymerizable groups. Mixtures of such compounds can be used, each compound having two or more unsaturated polymerizable groups, and some of the compounds having three, four, or more unsaturated polymerizable groups. For example, a free radically polymerizable component can be prepared by reacting DESMODUR® N100 aliphatic polyisocyanate resin based on hexamethylene diisocyanate (Bayer Corp., Milford, Conn.) with hydroxyethyl acrylate and pentaerythritol triacrylate. Useful free radically polymerizable compounds include NK Ester A-DPH (dipentaerythritol hexaacrylate) that is available from Kowa American, and Sartomer 399 (dipentaerythritol pentaacrylate), Sartomer 355 (di-trimethylolpropane tetraacrylate), Sartomer 295 (pentaerythritol tetraacrylate), and Sartomer 415 [ethoxylated (20)trimethylolpropane triacrylate] that are available from Sartomer Company, Inc.

Numerous other free radically polymerizable components are known in the art and are described in considerable literature including *Photoreactive Polymers: The Science and Technology of Resists*, A Reiser, Wiley, New York, 1989, pp. 102-177, by B. M. Monroe in *Radiation Curing: Science and Technology*, S. P. Pappas, Ed., Plenum, New York, 1992, pp. 399-440, and in "Polymer Imaging" by A. B. Cohen and P. Walker, in *Imaging Processes and Material*, J. M. Sturge et al. (Eds.), Van Nostrand Reinhold, New York, 1989, pp. 226-262. For example, useful free radically polymerizable components are also described in EP 1,182,033A1 (Fujimaki et al.), beginning with paragraph [0170], and in U.S. Pat. No. 6,309,792 (Hauck et al.), U.S. Pat. No. 6,569,603 (Furukawa), and U.S. Pat. No. 6,893,797 (Munnelly et al.) the disclosures of all of which are incorporated herein by reference. Other useful free radically polymerizable components include those described in U.S. Patent Application Publication 2009/0142695 (Baumann et al.), which disclosure of which is incorporated herein by reference.

The one or more free radically polymerizable components are generally present in a negative-working imageable layer in an amount of at least 10 weight % and up to and including 70 weight %, or typically of at least 20 weight % and up to and including 50 weight %, all based on the total dry weight of the negative-working imageable layer.

In addition, the negative-working imageable layer also comprises one or more radiation absorbers to provide desired radiation sensitivity or to convert radiation to heat, or both. In some embodiments, the one or more radiation absorbers are one or more different infrared radiation absorbers located in an infrared radiation-sensitive imageable layer so that the lithographic printing plate precursors can be imaged with infrared radiation-emitting lasers. The present invention is also applicable to lithographic printing plate precursors designed for imaging with violet lasers having emission peaks at around 405 nm, with visible lasers such as those having emission peaks around 488 nm or 532 nm, or with UV radiation having significant emission peaks below 400 nm. In such embodiments, the radiation absorbers can be selected to match the radiation source and many useful examples are known in the art.

The total amount of one or more radiation absorbers is at least 0.5 weight % and up to and including 30 weight %, or typically of at least 1 weight % and up to and including 15 weight %, based on the total dry weight of the radiation-sensitive imageable layer.

Useful infrared radiation absorbers can be pigments or infrared radiation absorbing dyes. Suitable dyes also those described in for example, U.S. Pat. No. 5,208,135 (Patel et al.), U.S. Pat. No. 6,153,356 (Urano et al.), U.S. Pat. No. 6,309,792 (Hauck et al.), U.S. Pat. No. 6,569,603 (Furukawa), U.S. Pat. No. 6,797,449 (Nakamura et al.), U.S. Pat. No. 7,018,775 (Tao), U.S. Pat. No. 7,368,215 (Munnelly et al.), U.S. Pat. No. 8,632,941 (Balbinot et al.), and U.S. Patent Application Publication 2007/056457 (Iwai et al.), the disclosures of all of which are incorporated herein by reference. In some infrared radiation-sensitive embodiments, it is desirable that at least one infrared radiation absorber in the infrared radiation-sensitive imageable layer be a cyanine dye comprising a tetraarylborate anion such as a tetraphenylborate anion. Examples of such dyes include those described in United States Patent Application Publication 2011/003123 (Simpson et al.) the disclosure of which is incorporated herein by reference.

In addition to low molecular weight IR-absorbing dyes, IR dye chromophores bonded to polymers can be used as well. Moreover, IR dye cations can be used as well, that is, the cation is the IR absorbing portion of the dye salt that ionically interacts with a polymer comprising carboxy, sulfo, phospho, or phosphono groups in the side chains.

The negative-working imageable layer also includes an initiator composition that provides free radicals upon exposure of that imageable layer to suitable radiation to initiate the polymerization of the one or more free radically polymerizable components. The initiator composition can be a single compound or a combination or system of a plurality of compounds.

Particularly useful compounds in the initiator composition are onium salts, each of which comprises a cation having at least one onium ion atom in the molecule, and an anion. Examples of the onium ion atom in the onium salt include sulfonium, iodonium, ammonium, phosphonium, and diazonium. Examples of the onium salts include triphenylsulfonium, diphenyliodonium, diphenyldiazonium, and derivatives obtained by introducing one or more substituents into the benzene ring of these compounds. Suitable substituents include but are not limited to, alkyl, alkoxy, alkoxycarbonyl, acyl, acyloxy, chloro, bromo, fluoro and nitro groups. Examples of anions in the onium salts are described for example in U.S. Pat. No. 7,524,614 (Tao et al.), the disclosure of which is incorporated herein by reference.

Furthermore, the onium salts described in paragraphs [0033] to [0038] of the specification of Japanese Patent Publication 2002-082429 [or U.S. Patent Application Publication 2002-0051934 (Ippei et al.), the disclosure of which is incorporated herein by reference] or the iodonium borate complexes described in U.S. Pat. No. 7,524,614 (noted above), can also be used in the present invention.

In some embodiments, the initiator composition can comprise a combination of initiator compounds such as a combination of iodonium salts, for example the combination of Compound A and Compound B described as follows.

Compound A can be represented by Structure (I) shown below, and the one or more compounds collectively known as compound B can be represented below by either Structure (II) or (III):

(I)

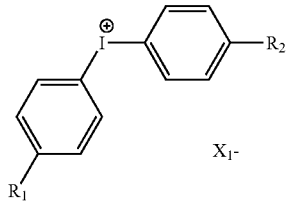

(II)

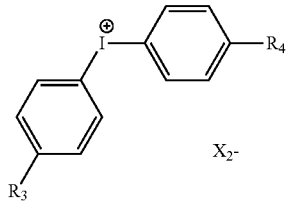

(III)

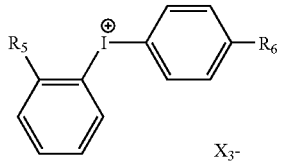

In these Structures (I), (II), and (III), $R_1$, $R_2$, $R_3$, $R_4$, $R_5$ and $R_6$ are independently substituted or unsubstituted alkyl groups or substituted or unsubstituted alkoxy groups, each of these alkyl or alkoxy groups having from 2 to 9 carbon atoms (or particularly from 3 to 6 carbon atoms). These substituted or unsubstituted alkyl and alkoxy groups can be in linear or branched form. In many useful embodiments, $R_1$, $R_2$, $R_3$, $R_4$, $R_5$ and $R_6$ are independently substituted or unsubstituted alkyl groups, such as independently chosen substituted or unsubstituted alkyl groups having 3 to 6 carbon atoms.

In addition, at least one of $R_3$ and $R_4$ can be different from $R_1$ or $R_2$; the difference between the total number of carbon atoms in $R_1$ and $R_2$ and the total number of carbon atoms in $R_3$ and $R_4$ is 0 to 4 (that is, 0, 1, 2, 3, or 4); the difference between the total number (sum) of carbon atoms in $R_1$ and $R_2$ and the total number (sum) of carbon atoms in $R_5$ and $R_6$ is 0 to 4 (that is, 0, 1, 2, 3, or 4); and $X_1$, $X_2$ and $X_3$ are the same or different anions.

Useful anions include but are not limited to, $ClO_4^-$, $PF_6^-$, $BF_4^-$, $SbF_6^-$, $CH_3SO_3^-$, $CF_3SO_3^-$, $C_6H_5SO_3^-$, $CH_3C_6H_4SO_3^-$, $HOC_6H_4SO_3^-$, $ClC_6H_4SO_3^-$, and borate anions represented by the following Structure:

$$B^-(R^1)(R^2)(R^3)(R^4)$$

wherein $R^1$, $R^2$, $R^3$, and $R^4$ independently represent substituted or unsubstituted alkyl, substituted or unsubstituted aryl (including halogen-substituted aryl groups), substituted or unsubstituted alkenyl, substituted or unsubstituted alkynyl, substituted or unsubstituted cycloalkyl, or substituted or unsubstituted heterocyclic groups, or two or more of $R^1$, $R^2$, $R^3$, and $R^4$ can be joined together to form a substituted or unsubstituted heterocyclic ring with the boron atom, such rings having up to 7 carbon, nitrogen, oxygen, or nitrogen atoms. The optional substituents on $R^1$, $R^2$, $R^3$, and $R^4$ can include chloro, fluoro, nitro, alkyl, alkoxy, and acetoxy groups. In some embodiments, all the $R^1$, $R^2$, $R^3$, and $R^4$ are the same or different substituted or unsubstituted aryl groups such as substituted or unsubstituted phenyl groups, or more likely all of these groups are unsubstituted phenyl groups. In many embodiments, at least one of $X_1$, $X_2$, and $X_3$ is a tetraarylborate anion comprising the same or different aryl groups, or in particularly useful embodiments, one or more is a tetraphenylborate anion or each of $X_1$, $X_2$, and $X_3$ is a tetraphenylborate anion.

Mixtures of Compound B compounds represented by Structures (II) or (III) can be used if desired. Many useful compounds represented by Structures (I), (II), and (III) can be obtained from commercial sources such as Sigma-Aldrich or they can be prepared using known synthetic methods and readily available starting materials.

The initiator composition is generally present in the negative-working imageable layer sufficient to provide one or more polymerization initiators in an amount of at least 3 weight % and up to and including 30 weight %, or typically of at least 5 weight % and up to and including 18 weight %, or even of at least 7 weight % and up to and including 15 weight %, all based on the total weight of the negative-working imageable layer.

It is optional but desirable in many embodiments that the negative-working imageable layer further comprise a polymeric material that acts as a polymeric binder for all the materials in the noted layer. Such "polymer binders" are different from the (a), (b), and (c) components described above, and are generally non-polymerizable and non-cross-linkable.

Such polymeric binders can be selected from polymeric binder materials known in the art including polymers comprising recurring units having side chains comprising polyalkylene oxide segments such as those described in for example, U.S. Pat. No. 6,899,994 (Huang et al.) the disclosure of which is incorporated herein by reference. Other useful polymeric binders comprise two or more types of recurring units having different side chains comprising polyalkylene oxide segments as described in for example WO Publication 2015-156065 (Kamiya et al.). Some of such polymeric binders can further comprise recurring units having pendant cyano groups as those described in for example U.S. Pat. No. 7,261,998 (Hayashi et al.) the disclosure of which is incorporated herein by reference.

Some useful polymeric binders are present in particulate form, that is, in the form of discrete particles (non-agglomerated particles). Such discrete particles can have an average particle size of at least 10 nm and up to and including 1500 nm, or typically of at least 80 nm and up to and including 600 nm, and that are generally distributed uniformly within the radiation-sensitive imageable layer. Other polymeric binders can be present as particles having an average particle size of at least 50 nm and up to and including 400 nm. Average particle size can be determined by various known methods including measuring the particles in electron scanning microscope images, and averaging a set number of measurements.

In some embodiments, the polymeric binder is present in the form of particles having an average particle size that is less than the average dry thickness (t) of the negative-working imageable layer. The average dry thickness (t) in micrometers (μm) is calculated by the following Equation:

$$t=w/r$$

wherein w is the dry coating coverage of the radiation-sensitive imageable layer in $g/m^2$ and r is 1 $g/cm^3$. For example, in such embodiments, the polymeric binder can comprise at least 0.05% and up to and including 80%, or more likely at least 10% and up to and including 50%, of the average dry thickness (t) of the negative-working imageable layer.

The polymeric binders also can have a backbone comprising multiple (at least two) urethane moieties as well as pendant groups comprising the polyalkylenes oxide segments.

Other useful polymeric binders also include those that comprise polymerizable groups such as acrylate ester group, methacrylate ester group, vinyl aryl group and allyl group and those that comprise alkali soluble groups such as carboxylic acid. Some of these useful polymeric binders are described in U.S. Patent Application Publication 2015/0099229 (Simpson et al.) and U.S. Pat. No. 6,916,595 (Fujimaki et al.), the disclosures of both of which are incorporated herein by reference.

Useful polymeric binders can be obtained from various commercial sources or they can be prepared using known procedures and starting materials, as described for example in publications described above.

When present, the total polymeric binders can be present in the negative-working imageable layer in an amount of at least 10 weight % and up to and including 70 weight %, or more likely in an amount of at least 20 weight % and up to and including 50 weight %, based on the total dry weight of the negative-working imageable layer.

Other polymeric materials known in the art can be present in the negative-working imageable layer as addenda and such polymeric materials are generally more hydrophilic than the polymeric binders described above. Example of such hydrophilic "secondary" polymeric binders include but are not limited to, cellulose derivatives such as hydroxypropyl cellulose, carboxymethyl cellulose, and polyvinyl alcohol with various degrees of saponification.

Additional additives to the negative-working imageable layer can include dye precursors and color developers as are known in the art. Useful dye precursors are described in U.S. Pat. No. 6,858,374 (Yanaka), the disclosure of which is incorporated herein by reference.

The negative-working imageable layer can include cross-linked polymer particles having an average particle size of at least 2 or of at least 4 μm, and up to and including 20 μm as described for example in U.S. Ser. No. 14/642,876 (filed Mar. 10, 2015 by Hayakawa et al.) and in U.S. Pat. No. 8,383,319 (Huang et al.) and U.S. Pat. No. 8,105,751 (Endo et al), the disclosures of all of which are incorporated herein by reference.

The negative-working imageable layer can also include a variety of other optional addenda including but not limited to, dispersing agents, humectants, biocides, plasticizers, surfactants for coatability or other properties, viscosity builders, pH adjusters, drying agents, defoamers, preservatives, antioxidants, development aids, rheology modifiers, or combinations thereof, or any other addenda commonly used in the lithographic art, in conventional amounts. The negative-working imageable layer can also include a phosphate (meth)acrylate having a molecular weight generally greater than 250 as described in U.S. Pat. No. 7,429,445 (Munnelly et al.) the disclosure of which is incorporated herein by reference.

Preparing Lithographic Printing Plate Precursors:

The negative-working lithographic printing plate precursors used in the practice of the present invention can be provided in the following manner. A negative-working imageable layer formulation comprising materials described above can be applied to a hydrophilic surface of a suitable substrate, usually as a continuous substrate web, as described above using any suitable equipment and procedure, such as spin coating, knife coating, gravure coating, die coating, slot coating, bar coating, wire rod coating, roller coating, or extrusion hopper coating. Such formulation can also be applied by spraying onto a suitable substrate. Typically, once the negative-working imageable layer formulation is applied at a suitable wet coverage, it is dried in a suitable manner known in the art to provide a desired dry coverage as noted below.

The manufacturing methods typically include mixing the various components needed for the negative-working imageable layer chemistry in a suitable organic solvent or mixtures thereof [such as methyl ethyl ketone (2-butanone), methanol, ethanol, 1-methoxy-2-propanol, iso-propyl alcohol, acetone, γ-butyrolactone, n-propanol, tetrahydrofuran, and others readily known in the art, as well as mixtures thereof], applying the resulting negative-working imageable layer formulation to the continuous substrate web, and removing the solvent(s) by evaporation under suitable drying conditions. After proper drying, the dry coating coverage of the negative-working imageable layer on the continuous substrate web is generally at least 0.1 $g/m^2$ and up to and including 4 $g/m^2$ or at least 0.4 $g/m^2$ and up to and including 2 $g/m^2$ but other dry coverage amounts can be used if desired.

In some embodiments, the negative-working imageable layer formulation used in this method is an infrared radiation-sensitive imageable layer formulation in which the one or more radiation absorbers are one or more infrared radiation absorbers.

Imaging and Off-Press Development

During use, a negative-working lithographic printing plate precursor can be exposed to a suitable source of exposing radiation depending upon the radiation absorber present in the negative-working imageable layer. In some embodiments where the negative-working imageable layer contains infrared radiation absorbers, the corresponding lithographic printing plate precursors can be imaged with infrared lasers that emit significant infrared radiation within the range of at least 750 nm and up to and including 1400 nm, or of at least 800 nm and up to and including 1250 nm. In other embodiments, the negative-working lithographic printing plate precursors can be imaged in the UV or visible regions of the electromagnetic spectrum using suitable sources of imaging radiation.

For example, imaging can be carried out using imaging or exposing radiation from a radiation-generating laser (or array of such lasers). Imaging also can be carried out using imaging radiation at multiple wavelengths at the same time if desired. The laser used to expose the precursor is usually a diode laser, because of the reliability and low maintenance of diode laser systems, but other lasers such as gas or solid-state lasers can also be used. The combination of power, intensity and exposure time for radiation imaging would be readily apparent to one skilled in the art.

The imaging apparatus (or imaging means) can be configured as a flatbed recorder or as a drum recorder, with the radiation-sensitive lithographic printing plate precursor mounted to the interior or exterior cylindrical surface of the drum. An example of useful imaging apparatus is available as models of KODAK® Trendsetter platesetters (Eastman Kodak Company) and NEC AMZISetter X-series (NEC Corporation, Japan) that contain laser diodes that emit radiation at a wavelength of about 830 nm. Other suitable imaging apparatus includes the Screen PlateRite 4300 series or 8600 series platesetters (available from Screen USA, Chicago, Ill.) or thermal CTP platesetters from Panasonic Corporation (Japan) that operates at a wavelength of 810 nm.

In embodiments where an infrared radiation source is used, imaging energies can be at least 30 $mJ/cm^2$ and up to and including 500 $mJ/cm^2$ and typically at least 50 $mJ/cm^2$ and up to and including 300 $mJ/cm^2$ depending upon the sensitivity of the radiation-sensitive imageable layer.

After imagewise exposing, the exposed negative-working lithographic printing plate precursors having exposed regions and non-exposed regions in the negative-working imageable layer can be processed in a suitable manner to remove the non-exposed regions.

Processing can be carried out off-press using any suitable developer in one or more successive applications (treatments or developing steps) of the same or different processing solution. Such one or more successive processing treatments can be carried out with exposed precursors for a time sufficient to remove the non-exposed regions of the negative-working imageable layer to reveal the hydrophilic surface of the substrate, but not long enough to remove significant amounts of the exposed regions that have been hardened in the same layer. During lithographic printing, the revealed hydrophilic substrate surface repels inks while the remaining exposed regions accept lithographic printing ink. After such processing off-press, one or more lithographic printing plates can be used for lithographic printing of newsprint.

Prior to such off-press processing, the exposed precursors can be subjected to a "pre-heating" process to further harden the exposed regions in the negative-working imageable layer. Such optional pre-heating can be carried out using any known process and equipment generally at a temperature of at least 60° C. and up to and including 180° C.

Following this optional pre-heating, or in place of the pre-heating, the exposed precursor can be washed (rinsed). Such optional washing (or rinsing) can be carried out using any suitable aqueous solution (such as water or an aqueous solution of a surfactant) at a suitable temperature and for a suitable time that would be readily apparent to one skilled in the art.

Useful developers can be ordinary water or can be formulated aqueous solutions. The formulated developers can comprise one or more components selected from surfactants, organic solvents, alkali agents, and surface protective agents. For example, useful organic solvents include the reaction products of phenol with ethylene oxide and propylene oxide [such as ethylene glycol phenyl ether (phenoxyethanol)], benzyl alcohol, esters of ethylene glycol and of propylene glycol with acids having 6 or less carbon atoms, and ethers of ethylene glycol, diethylene glycol, and of propylene glycol with alkyl groups having 6 or less carbon atoms, such as 2-ethylethanol and 2-butoxyethanol.

Examples of useful developers for carrying out the present invention are available as TN-D1 (Kodak Japan Ltd.), TN-D2 (Kodak Japan Ltd.), and HN-D (FUJIFILM Global Graphic Systems Co, Ltd.). These developers are provided in concentrated form, and can be used when diluted with water at specified dilution ratios.

Following development, the exposed and developed precursor can be washed (rinsed) to remove residual developer solution, and then can be treated with a gumming solution that is capable of protecting (or "gumming") the lithographic image on the lithographic printing plate against contamination or damage (for example, from oxidation, fingerprints, dust, or scratches).

Examples of useful gumming solutions are available as LNF-11 (Kodak Japan Ltd.), LNF-12 (Kodak Japan Ltd.) and HN-GV (FUJIFILM Global Graphic Systems Co, Ltd.). All gumming solutions are provided in concentrated form and can be used when diluted with water at specified dilution ratios.

In some instances, an aqueous processing solution can be used off-press to both develop the imaged precursor by removing the non-exposed regions and provide a protective layer or coating over the entire imaged and developed (processed) precursor printing surface. In this embodiment, the aqueous solution behaves somewhat like a gum that protects (or "gums") the lithographic image on the printing plate against contamination or damage (for example, from oxidation, fingerprints, dust, or scratches).

After the described off-press processing and optional drying, it is optional to further bake the lithographic printing plate with or without blanket or floodwise exposure to UV or visible radiation. Printing can be carried out by putting the exposed and processed lithographic printing plate on a suitable printing press, and applying a lithographic printing ink and fountain solution to the printing surface of the lithographic printing plate in a suitable manner. The fountain solution is taken up by the surface of the hydrophilic substrate revealed by the exposing and processing steps, and the lithographic ink is taken up by the remaining (exposed) regions of the imageable layer. The lithographic ink is then transferred to a suitable receiving material (such as cloth, paper, metal, glass, or plastic) to provide a desired impression of the image thereon. If desired, an intermediate "blanket" roller can be used to transfer the lithographic ink from the lithographic printing plate to the receiving material (for example, sheets of paper).

On-Press Development

As an alternative to off-press development, the exposed lithographic printing plate precursors can be developed on-press using a lithographic printing ink, a fountain solution, or a combination of a lithographic printing ink and a fountain solution. In such embodiments, an imaged radiation-sensitive lithographic printing plate precursor can be mounted onto a printing press and the printing operation is begun for example during lithographic printing of newsprint. The non-exposed regions in the negative-working imageable layer are removed by a suitable fountain solution, lithographic printing ink, or a combination of both, when the initial printed impressions are made. Typical ingredients of aqueous fountain solutions include pH buffers, desensitizing agents, surfactants and wetting agents, humectants, low boiling solvents, biocides, antifoaming agents, and sequestering agents. A representative example of a fountain solution is Varn Litho Etch 142W+Varn PAR (alcohol sub) (available from Varn International, Addison, Ill.).

In a typical printing press startup with a sheet-fed printing machine, the dampening roller is engaged first and supplies fountain solution to the mounted imaged precursor to swell the exposed radiation-sensitive imageable layer at least in the non-exposed regions. After a few revolutions, the inking rollers are engaged and they supply lithographic printing ink(s) to cover the entire printing surface of the lithographic printing plates. Typically, within 5 to 20 revolutions after the inking roller engagement, printing sheets are supplied to remove the non-exposed regions of the negative-working imageable layer from the lithographic printing plate as well as materials on a blanket cylinder if present, using the formed ink-fountain emulsion.

On-press developability of the lithographic printing precursors is particularly useful when the precursor comprises one or more polymeric binders in the negative-working imageable layer, at least one of which polymeric binders is present as particles having an average diameter of at least 50 nm and up to and including 400 nm.

The present invention provides at least the following embodiments and combinations thereof, but other combinations of features are considered to be within the present invention as a skilled artisan would appreciate from the teaching of this disclosure:

1. A method for preparing one or more lithographic printing plates from one or more negative-working lithographic printing plate precursors, comprising:

providing an imaging apparatus comprising: imaging means; and an enclosure that completely surrounds the imaging means, which enclosure comprises an air intake unit for providing controlled air flow into the enclosure;

using a means for removing ozone either from the controlled air flow into the enclosure or from ambient air within the enclosure;

supplying one or more negative-working lithographic printing plate precursors to the imaging means, each negative-working lithographic printing plate precursor comprising a substrate having thereon a negative-working imageable layer;

imagewise exposing the one or more negative-working lithographic printing plate precursors to provide one or more imaged precursors comprising exposed regions and non-exposed regions in the negative-working imageable layer; and processing the one or more imaged precursors to remove the non-exposed regions in the negative-working imageable layer, to form one or more lithographic printing plates.

2. The method of embodiment 1, wherein the imaging apparatus further comprises a stack of multiple negative-working lithographic printing plate precursors; and an automatic loading device, and the step of supplying one or more negative-working lithographic printing plate precursors to the imaging means is performed by operating the automatic loading device to load the one or more negative-working lithographic printing plate precursors from the stack onto the imaging means.

3. The method of embodiment 2, wherein the multiple negative-working lithographic printing plate precursors are arranged in the stack without interleaf papers.

4. The method of any of embodiments 1 to 3, wherein the means for removing ozone comprises one or more ozone removing filters.

5. The method of any of embodiments 1 to 4, wherein the imaging apparatus comprises a housing as the enclosure and the means for removing ozone is within the housing.

6. The method of any of embodiments 1 to 5, comprising removing at least 50 mol % of ozone from the ambient air within the enclosure.

7. The method of any of embodiments 1 to 6, comprising removing at least 50 mol % of ozone from the controlled air flow into the enclosure.

8. The method of any of embodiments 1 to 7, wherein the one or more negative-working lithographic printing plate precursors comprise a negative-working imageable layer that is the outermost layer.

9. The method of any of embodiments 1 to 8, wherein the one or more negative-working lithographic printing plate precursors are infrared radiation-sensitive.

10. The method of any of embodiments 1 to 9, wherein the negative-working imageable layer comprises:

(a) one or more free radically polymerizable components;

(b) an initiator composition that provides free radicals upon exposure of the negative-working imageable layer to radiation;

(c) one or more radiation absorbers; and optionally, (d) a polymeric binder that is different from all of (a), (b), and (c).

11. The method of embodiment 10, wherein the negative-working imageable layer is infrared radiation-sensitive, and the one or more radiation absorbers comprises at least one infrared radiation absorber.

12. The method of any of embodiments 1 to 11, comprising:

the step of processing the one or more imaged precursors on-press using a fountain solution, a lithographic printing ink, or both a fountain solution and a lithographic printing ink.

13. The method of any of embodiments 1 to 12, further comprising:

using the one or more lithographic printing plates for lithographic printing during and subsequently to processing.

14. The method of embodiment 13, comprising:

using the one or more lithographic printing plates for lithographic printing of newsprint.

15. The method of any of embodiments 1 to 11, comprising:

processing the one or more imaged precursors off-press; and using the one or more lithographic printing plates for lithographic printing of newsprint.

The following Examples are provided to illustrate the practice of this invention and are not meant to be limiting in any manner.

Preparation of Printing Plate Precursors:

Electrochemically grained substrates were prepared and one planar surface was further treated with anodizing phosphoric acid under a typical manufacturing condition for making negative-working lithographic printing plate precursors. The anodic layer thickness was 500 nm for each substrate. Each substrate was then coated with a poly(acrylic acid) aqueous solution to cover its anodized surface and then dried to form a hydrophilic layer having a coverage rate of 0.03 g/m$^2$. The negative-working imageable layer formulation shown in TABLE 1 below was then coated on the hydrophilic layer of each substrate and dried at 110° C. for 40 seconds to form a negative-working imageable layer at a dry coverage of 0.9 g/m$^2$.

TABLE I

| Imageable Layer Formulation Component | Weight % |
|---|---|
| 1-Propanol | 39.750 |
| 2-Butanone | 40.000 |
| γ-Butyrolactone | 0.880 |
| Water | 8.600 |
| Polymer emulsion A[1)] | 6.950 |
| KLUCEL ® E[2)] | 0.250 |
| Urethane acrylate[3)] | 1.650 |
| Sartomer SR399[4)] | 0.770 |
| Iodonium, bis[4-(1-methylethyl)phenyl]-, tetraphenylborate(1-) (1:1) | 0.300 |
| Infrared absorbing dye A (see below) | 0.150 |
| 3-Mercapto-1,2,4-triazole | 0.050 |
| BYK ® 336[5)] | 0.180 |
| Techpolymer SSX-105[6)] | 0.470 |
| Total | 100.000 |

[1)]Particulate primary polymeric binder emulsion prepared from Polyethylene glycol methyl ether methacrylate/-Acrylonitrile/Styrene at 10/70/20 weight % ratio (24% by mass solution in 1-propanol/water at 76/24 weight % solvent mix, average particle size is 250 nm);
[2)]Hydroxypropyl cellulose (Hercules Inc.);
[3)]2-Butanone solution with a concentration of 80% by mass of a polymerizable compound obtained by reacting DESMODUR ® N100 with hydroxyethyl acrylate and pentaerythritol triacrylate;
[4)]Trimethylol propanetetraacrylate (Sartomer Company);
[5)]Xylene/methoxypropyl acetate solution with a concentration of 25% by mass of a modified polydimethylsiloxane copolymer; and
[6)]Crosslinked acrylic beads, average particle size is 5.0 μm (Sekisui Plastics Co., Ltd.).

Infrared Absorbing Day A

S2171

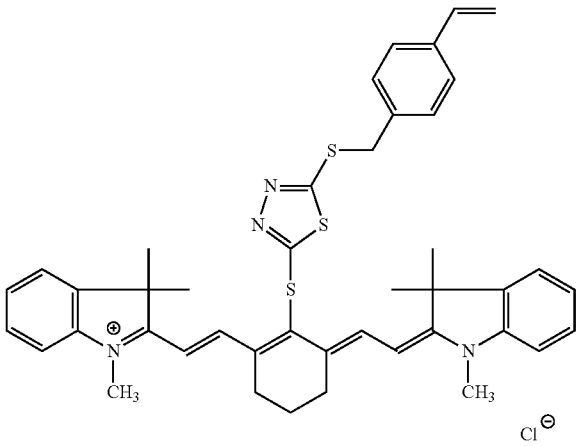

Invention Example 1

A pallet of 500 negative-working lithographic printing plate precursors was prepared and placed inside the housing (enclosure) of an imaging apparatus containing a platesetter as an imaging means (Plateliner GX-9700 from Panasonic) as illustrated in FIG. 1. An ozone removing means (or air cleaning unit) containing an activated charcoal filter (PMAC-100 from Iris Oyama) was installed and operated inside the housing. The pallet of 500 negative-working lithographic printing plate precursors was left in place for 36 hours with the upper most precursor negative-working imageable layer exposed to ambient air within the housing.

The negative-working lithographic printing plate precursors stored in this manner were imagewise exposed in the platesetter as described below, and the results are described below in TABLE II.

Invention Example 2

Invention Example 1 was repeated except that the ozone removing means (air cleaning unit) was installed and operated outside the housing (enclosure) of the imaging apparatus as illustrated in FIG. 2 and the resulting purified air from which ozone had been removed was fed into the air intake unit of the imaging means through a flexible air tube.

The negative-working lithographic printing plate precursors stored in this manner were imagewise exposed in the platesetter as described below, and the results are described below in TABLE II.

Invention Example 3

Invention Example 1 was repeated except that the ozone removing means (air cleaning unit) was an activated charcoal filter placed in the path of the air intake unit as illustrated in FIG. 3.

The negative-working lithographic printing plate precursors stored in this manner were imagewise exposed in the platesetter as described below, and the results are described below in TABLE II.

Invention Example 4

Invention Example 2 was repeated except that the flexible air tube was removed and the ozone removing means (air cleaning unit) was installed and operated near and in the same room at the imaging apparatus as illustrated in FIG. 4.

The negative-working lithographic printing plate precursors stored in this manner were imagewise exposed in the platesetter as described below, and the results are described below in TABLE II.

Comparative Example 1

Invention Example 1 was repeated except that no ozone removing means (air cleaning unit) was installed or operated. The pallet of negative-working lithographic printing plate precursors was left in place for 36 hours with the uppermost precursor negative-working imageable layer being exposed to ambient air.

The negative-working lithographic printing plate precursors stored in this manner were imagewise exposed in the platesetter as described below, and the results are described below in TABLE II.

Evaluation of IR-Sensitivity:

The uppermost and the second uppermost negative-working lithographic printing plate precursors from each pallet of multiple precursors used in Invention Examples 1 to 4 and in Comparative Example 1 were imagewise exposed to infrared radiation using a Magnus800 platesetter (Kodak Japan Ltd.) to provide six exposed patches on each of the precursors using infrared radiation energy from 26 mJ/cm$^2$ to 124 mJ/cm$^2$ in 6 steps. The imagewise exposed precursors were hand-inked in the presence of tap water to show the lowest energy required to retain the non-exposed regions of the negative-working imageable layer on each precursor. This lowest energy was recorded as the IR sensitivity and is shown in TABLE II below.

TABLE II

| | Uppermost Precursor | Second uppermost Precursor |
|---|---|---|
| Invention 1 | 26 mJ/cm$^2$ | 26 mJ/cm$^2$ |
| Invention 2 | 26 mJ/cm$^2$ | 26 mJ/cm$^2$ |
| Invention 3 | 26 mJ/cm$^2$ | 26 mJ/cm$^2$ |
| Invention 4 | 45.6 mJ/cm$^2$ | 26 mJ/cm$^2$ |
| Comparative 1 | No image even at 124 mJ/cm$^2$ | 26 mJ/cm$^2$ |

The data in TABLE II indicate that in Invention Examples 1 through 3, the uppermost precursors were well protected from the effects of ambient ozone on IR sensitivity in the imaging apparatus arrangements illustrated in FIGS. 1-3. In Invention Example 4, the uppermost precursor protection from the effect of ambient ozone on IR sensitivity was not as high because the de-ozonized air was diluted with the ambient room air in the imaging apparatus arrangement illustrated in FIG. 4. The negative-working lithographic printing plate precursors that were stored and tested in Comparative Example 1 had no sensitivity to infrared radiation due to the high concentration of ozone around the precursors.

The invention has been described in detail with particular reference to certain preferred embodiments thereof, but it will be understood that variations and modifications can be effected within the spirit and scope of the invention.

PARTS LIST

10 imaging apparatus
15 imaging means (platesetter)
20 enclosure
25 air intake unit
30 direction of air flow
35 ozone removing means
40 pallets of multiple negative-working lithographic printing plate precursors
45 direction of moving imaged precursors to development
50 flexible air tube

The invention claimed is:

1. A method for preparing one or more lithographic printing plates from one or more infrared radiation-sensitive negative-working lithographic printing plate precursors, each having a negative-working imageable layer, the method comprising:

providing an imaging apparatus comprising: imaging means containing infrared radiation lasers capable of imagewise exposing each infrared radiation-sensitive negative-working lithographic printing plate precursor to imaging infrared radiation to provide exposed regions and non-exposed regions in the negative-working imageable layer; and an enclosure that completely surrounds the imaging means, which enclosure comprises an air intake unit for providing controlled air flow into the enclosure;

using a means for removing ozone either from the controlled air flow into the enclosure or from ambient air within the enclosure;

supplying one or more infrared radiation-sensitive negative-working lithographic printing plate precursors to the imaging means, each infrared radiation-sensitive negative-working lithographic printing plate precursor comprising a substrate having thereon the a negative-working imageable layer;

imagewise exposing the one or more infrared radiation-sensitive negative-working lithographic printing plate precursors to the infrared radiation lasers, to provide one or more imaged precursors comprising exposed regions and non-exposed regions in the negative-working imageable layer; and processing the one or more imaged precursors to remove the non-exposed regions in the negative-working imageable layer, to form one or more lithographic printing plates.

2. The method of claim 1, wherein the imaging apparatus further comprises a stack of multiple infrared radiation-sensitive negative-working lithographic printing plate precursors; and an automatic loading device, and the step of supplying the one or more infrared radiation-sensitive negative-working lithographic printing plate precursors to the imaging means is performed by operating the automatic loading device to load the one or more infrared radiation-sensitive negative-working lithographic printing plate precursors from the stack onto the imaging means.

3. The method of claim 2, wherein the multiple infrared radiation-sensitive negative-working lithographic printing plate precursors are arranged in the stack without interleaf papers.

4. The method of claim 1, wherein the means for removing ozone comprises one or more ozone removing filters.

5. The method of claim 1, wherein the imaging apparatus comprises a housing as the enclosure and the means for removing ozone is within the housing.

6. The method of claim 1, comprising removing at least 50 mol % of ozone from the ambient air within the enclosure.

7. The method of claim 1, comprising removing at least 50 mol % of ozone from the controlled air flow into the enclosure.

8. The method of claim 1, wherein the one or more infrared radiation-sensitive negative-working lithographic printing plate precursors comprise a the negative-working imageable layer as the outermost layer.

9. The method of claim 1, wherein the negative-working imageable layer comprises:

(a) one or more free radically polymerizable components;

(b) an initiator composition that provides free radicals upon exposure of the negative-working imageable layer to radiation;

(c) one or more infrared radiation absorbers; and optionally, (d) a polymeric binder that is different from all of (a), (b), and (c).

10. The method of claim 1, comprising:

the step of processing the one or more imaged precursors on-press using a fountain solution, a lithographic printing ink, or both a fountain solution and a lithographic printing ink.

11. The method of claim 1, Anther comprising:

using the one or more lithographic printing plates for lithographic printing during and subsequently to processing.

12. The method of claim 11, comprising:

using the one or more lithographic printing plates for lithographic printing of newsprint.

13. The method of claim 1, comprising:

processing the one or more imaged precursors off-press; and using the one or more lithographic printing plates for lithographic printing of newsprint.

14. The method of claim 1, wherein the ozone level within the enclosure is less than the ozone level outside the enclosure.

* * * * *